United States Patent [19]

Beaussier et al.

[11] 4,405,665

[45] Sep. 20, 1983

[54] GROUND COVERING WITH DRAINAGE-PROMOTING MEMBERS

[75] Inventors: Michel Beaussier, Balan; Henry Lesch; Emile Evon, both of Mouzon, all of France

[73] Assignee: Societe Internationale de Revetements de sol S.A. - S.I.R.S., Neuilly-Sur-Seine, France

[21] Appl. No.: 370,396

[22] Filed: Apr. 21, 1982

[30] Foreign Application Priority Data

Jul. 28, 1981 [FR] France ..... 81 15063

[51] Int. Cl.[3] ..... A01N 3/00; B32B 33/00

[52] U.S. Cl. ..... 428/17; 428/95

[58] Field of Search ..... 428/17, 95

[56] References Cited

U.S. PATENT DOCUMENTS 2,023,307 12/1935 Burton ..... 428/17

2,515,847 7/1950 Winkler ..... 428/17

*Primary Examiner*—Marion McCamish

*Attorney, Agent, or Firm*—Karl F. Ross; Herbert Dubno

[57] ABSTRACT

An artificial turf consists of a pile of filaments or strips of propylene or like weather-resistant material bonded to a support which can be doubled and which is provided on its reverse with an array of synthetic resin material projections disposed discontinuously along the underside. These projections are in the form of truncated pyramids with substantially rectangular bases and prevent migration of the covering because of walking on the ground covering.

9 Claims, 5 Drawing Figures

FIG. 1
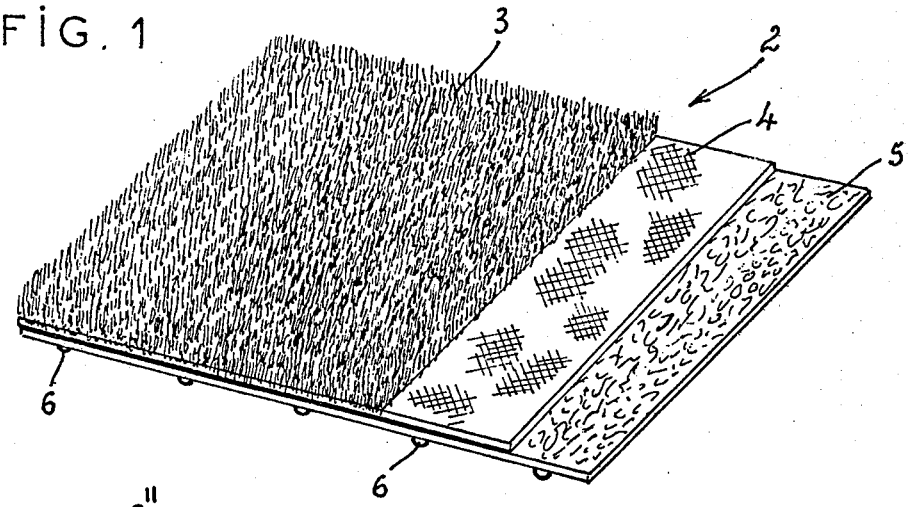
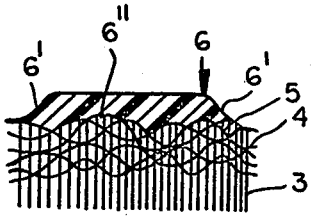
FIG.5
FIG. 2
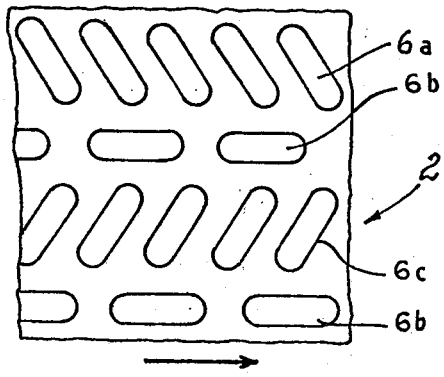
FIG. 3
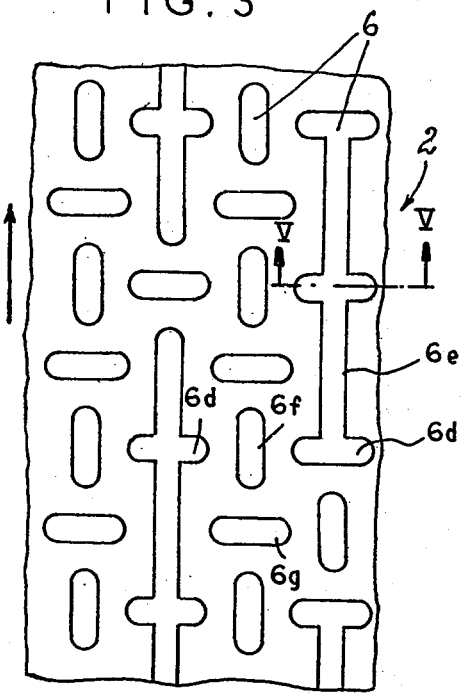
FIG. 4
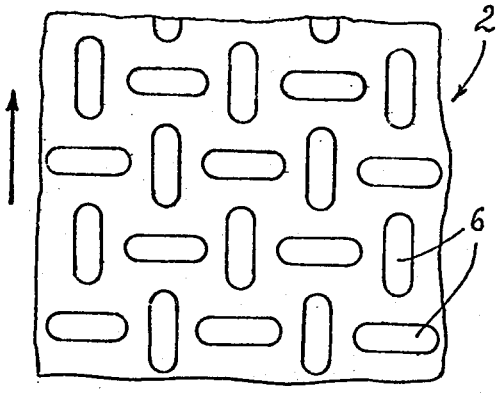

GROUND COVERING WITH DRAINAGE-PROMOTING MEMBERS

FIELD OF THE INVENTION

Our present invention relates to a ground covering and, more particularly, to a ground covering provided on its reverse side with means facilitating drainage. The invention is especially directed to ground covering of the type which is adapted to simulate lawns or grassy areas, e.g. artificial turf.

BACKGROUND OF THE INVENTION

Artificial turf has been developed to cover exposed surfaces with a material resembling lawns or grassy areas and which are exposed to the elements and must be able to retain their appearance and wear properties even after much usage and severe treatment, while permitting moisture, e.g. rain, to pass through to the underlying substrate. The latter substrate can be ground which is capable of absorbing the water or concrete or some other base which can be formed with drains which permit the water passing through the artificial turf of accumulate and be drawn off.

The synthetic grass may comprise an upper layer of cut pile, composed of a weather-resistant synthetic resin monofilament and anchored to a support layer which is provided with voids which can be traversed by the water.

The pile can be anchored to the support by thermal welding, by needling through the support and/or by the application of adhesives or bonding agents which should also be resistant to weathering and do not tend to decompose, mold or decay in a moist state.

Synthetic turfs have also been formed from molded thermoplastic materials which are perforated to provide openings through which the water can pass, and formed with projections adapted to simulate natural ground cover.

In practically all of the above-described cases, the artificial turf must be provided with means for permitting drainage away from the reverse side of the ground covering, especially when an exterior use is planned.

However, the various methods of providing such drainage means heretofore have created an assortment of problems.

For example, it is known to provide a drainage-promoting arrangement in the form of projections from the reverse side of the artificial turf, e.g. as plugs, having a hemispherical configuration and composed of synthetic resin material, rubber or the like.

Such coverings are primarily used to cover concrete surfaces, balconies, aprons surrounding swimming pools and the like.

An important disadvantage of such devices is that repeated walking over the surface of the ground covering induces a migration of the ground covering upon the supporting surface. Apparently, as the user takes a step upon the ground covering, the foot pressure causes pivoting about the projections on the reverse side of the ground covering and a component of movement of the latter in the opposite direction to the orientation of the fibers on the surface. Some of the components may be contributed by pivotal action directly at the pile surface.

Regardless of the cause, the artificial turf undergoes a barely perceptible movement with each step. After eight hours of heavy traffic upon the covering, however, a displacement of several scores of centimeters can be detected.

OBJECTS OF THE INVENTION

It is the principal object of the present invention to provide a ground covering which obviates this disadvantage.

Another object of this invention is to provide a ground covering or artificial turf which has improved means for promoting drainage and yet does not tend to migrate significantly, even with heavy foot traffice.

SUMMARY OF THE INVENTION

These objects and others which will become apparent hereinafter are obtained, in accordance with the present invention, in a water-permeable ground covering provided with an upper wear layer, advantageously formed with an artificial grass pile, composed of filaments or strips of a nonputrescible synthetic resin material fixed to a support layer which is water-permeable.

This support which can be doubled or increased in thickness by backing it with a reinforcement layer, is provided on its lower side or reverse with a draining system. According to the invention, this draining system is constituted by discontinuous elements projecting downwardly from the ground covering and composed of synthetic resin material in the form of truncated pyramids of a generally rectangular base.

According to a feature of the invention, one part at least of these discontinuous elements can be disposed so that their major or longitudinal dimension is parallel to the longitudinal direction of the ground covering.

According to another feature of the invention and the best mode thereof, the permeable ground covering is constituted by a wear layer of filaments or strips of nonputrescible synthetic resin material implanted by tufting in a woven or nonwoven support, the assembly being doubled by a nonwoven reinforcement layer or additional support.

BRIEF DESCRIPTION OF THE DRAWING

The above and other objects, features an advantages of the present invention will become more readily apparent from the following description, reference being made to the accompanying drawing in which:

FIG. 1 is a perspective view, partly broken away, diagrammatically illustrating a ground covering according to the invention;

FIGS. 2, 3 and 4 are plan views showing various arrangements of the projections on the underside of the ground covering; and FIG. 5 is a cross-sectional view taken along the line V—V of FIG. 3 but drawn to an enlarged scale.

SPECIFIC DESCRIPTION

The ground covering, artificial turf or synthetic grass carpeting, represented at 2 in FIG. 1, comprises as is conventional in the art, a wear layer 3 which forms the grass-like array of pile and is composed of strips of polypropylene colored to imitate grass and implanted vertically by tufting in a nonwoven or woven support 4 which can also be composed of strips of polypropylene.

The anchorage of the tufts to the support 4 is effected by thermal-welding so that the fibers or pile elements are fixed at their lower ends to the support.

The support 4 is backed by a nonwoven layer 5 which serves as a doubling or reinforcing layer to increase the thickness of the carpet and its resilience while maintaining the high porosity of the assembly.

The support for the tufts can be varied as to gauge, tension, thickness of the filaments or fibers as may be required for the proposed use and likewise can be composed of nonwoven or woven layers of polypropylene.

We have found that best results are obtained with a support which has a weight per square meter of 100–250 g and provides highly effective resistance to sunlight and other weathering conditions.

As previously noted, the doubling support 5 is a nonwoven layer and this layer can be composed of polyester fibers or glass fibers.

According to the invention (see FIGS. 2–4) the underside of the ground covering 2 is provided with drainage means constituted by discontinuous elements 6 which project downwardly and are composed of synthetic resin material, such as a polystyrene resin, a butadiene, acrylic, vinyl chloride or like polymer, copolymer or mixed polymer, polyurethane or the like. The projections 6 can also be composed of natural latex or synthetic or natural rubber.

In general, the projections have the cross section of a frustopyramid, i.e. the flanks 6' converge away from the base 6'' (see FIG. 5) without sharp angles, i.e. all of the angles may be rounded.

As is apparent from FIG. 2, the elements 6 can be disposed in a pattern consisting of parallel rows extending parallel to the length of the covering as represented by the arrow. The rows of biased elements **6*a* and 6*c* are separated by rows of elements 6*b*** which are aligned in this direction.

In the embodiment shown in FIG. 3, the discontinuous relief elements extend parallel to the longitudinal direction represented by the arrow and have cross-bars **6*d*** which are comparatively short and extend perpendicular to this direction.

Rows of the longitudinal elements **6*e* can be separated by rows of elements which alternate between orientation in the longitudinal and in the transverse direction as shown at 6*f* and 6*g***, respectively.

In the embodiment shown in FIG. 4, the elements which extend in the longitudinal direction and in the transverse direction are parallel to one another.

The various elements can have the same length as in FIG. 4 and FIG. 2, or can be of different length as shown in FIG. 3.

Since in all of the embodiments disclosed, the discontinuous elements are spaced apart in rows in the longitudinal diemension of the carpeting, and these rows are transversely spaced and partly overlap as is the case where transverse elements are provided (FIGS. 3 and 4), the carpeting has a surface in contact with the ground which precludes oscillation as the carpeting is walked upon.

The elements 6 can be bonded to the lower support 5 by any means known per se, e.g. thermal bonding, weather-resistant adhesives or the like.

Utilizing the pattern shown in FIGS. 2–4, experiments have demonstrated that after heavy traffic over a period of over eight hours in direction opposite the orientation of the fibers on the surface, the displacement does not exceed two centimeters.

As is also apparent from FIG. 5, the tufts or elements of polypropylene which form the wear surface of the artificial turf can extend through the support 4 into the support 5 and can be thermally welded to the support 4 and the support 5 while the two supports are thermally bonded together.

We claim:

1. A water-permeable artificial turf ground covering, comprising:

a water-permeable wear layer formed with:

a grass-like array of nonputrescible synthetic resin pile tufts a water-permeable nonwoven or woven synthetic resin support thermally bonded to said tufts at lower ends thereof, and a nonwoven layer composed of polyester or glass fibers reinforcing said support and located therebelow; and an array of drainage-promoting members formed on an underside of said nonwoven layer opposite said elements, said members being disposed discontinuously along said underside of said layer and being composed of synthetic resin material and having the form of truncated pyramids with substantially rectangular bases.

2. The ground covering defined in claim 1 wherein said layers are bonded to said members.

3. The ground covering defined in claim 2 having a longitudinal dimension, said members extending at least in part in rows parallel to said longitudinal dimension.

4. The ground covering defined in claim 3 wherein at least some of the members of each of said rows extend parallel to said longitudinal dimension.

5. The ground covering defined in claim 4 wherein the members of at least some of said rows overlap gaps between members in others of said rows.

6. The ground covering defined in claim 5 wherein all of said members are of substantially the same length.

7. The ground covering defined in claim 5 wherein said elements have different lengths.

8. The ground covering defined in claim 5 wherein, within each row, some of said members are aligned in said direction longitudinally and others of said elements extend transversely to said dimension.

9. The ground covering defined in claim 5 wherein said support is bonded to said lower layer by thermal welding effected conjointly with the welding of said elements to said support.

* * * * *